United States Patent [19]

Brothers et al.

[11] 3,930,599

[45] Jan. 6, 1976

[54] CAP FOR CAULKING CARTRIDGE

[75] Inventors: Don R. Brothers, Canfield; Stephen E. Toth, Brooklyn Heights, both of Ohio

[73] Assignee: Century Industries Corporation, New Waterford, Ohio

[22] Filed: Feb. 14, 1975

[21] Appl. No.: 549,811

Related U.S. Application Data

[63] Continuation-in-part of Ser. No. 418,600, Nov. 23, 1973, abandoned.

[52] U.S. Cl. ..... 222/143; 222/192; 222/546; 220/306; 220/380; 401/139; 222/562

[51] Int. Cl.[2] ..... B65D 41/18

[58] Field of Search ..... 222/562, 546, 325-327, 222/182, 143, 192; 220/85 P, 306, 380, 85 D; 401/139, 190

[56] References Cited

UNITED STATES PATENTS

| | | | |
|---|---|---|---|
| 1,481,508 | 1/1924 | Harris | 401/139 |
| 3,021,037 | 2/1962 | Parker | 222/562 X |
| 3,179,313 | 4/1965 | Malglaive | 222/562 X |
| 3,237,800 | 3/1966 | Edwards | 220/380 X |
| 3,322,298 | 5/1967 | Gach | 220/306 |
| 3,322,299 | 5/1967 | Foster | 220/306 |
| 3,351,249 | 11/1967 | Stull | 222/546 X |
| 3,732,591 | 5/1973 | Gach | 222/192 X |

FOREIGN PATENTS OR APPLICATIONS

| | | | |
|---|---|---|---|
| 200,496 | 11/1958 | Austria | 222/546 |
| 56,473 | 6/1967 | Germany | 220/306 |
| 922,188 | 3/1963 | United Kingdom | 222/546 |
| 613,833 | 12/1960 | Italy | 220/306 |

*Primary Examiner*—Robert B. Reeves
*Assistant Examiner*—Charles A. Marmor
*Attorney, Agent, or Firm*—Sidney W. Millard

[57] ABSTRACT

A cap for a caulking cartridge of the type having an elongated dispensing spout extending generally coaxially outward from one end thereof. The cap includes a spout receiver which, when the cap is in position, closely embraces a portion of the elongated spout to prevent undesired emission and hardening of the caulking or the like compound during cartridge storage between uses. The cap also includes a resilient u-shaped bead receiver for closely engaging the end of the caulking cartridge adjacent the dispensing spout and structure releasing the cap from its engaging position. The releasing structure may also be used for conveniently hanging the cartridge during storage. The cap is dimensioned so at least the outermost end may be received in another, substantially identical cartridge at the opposite end from its dispensing end for ease of packing, shipping and shelf storage purposes as to a substantial number of the cartridges having the caps. A forming blade may be attached to the side of the cap.

10 Claims, 11 Drawing Figures

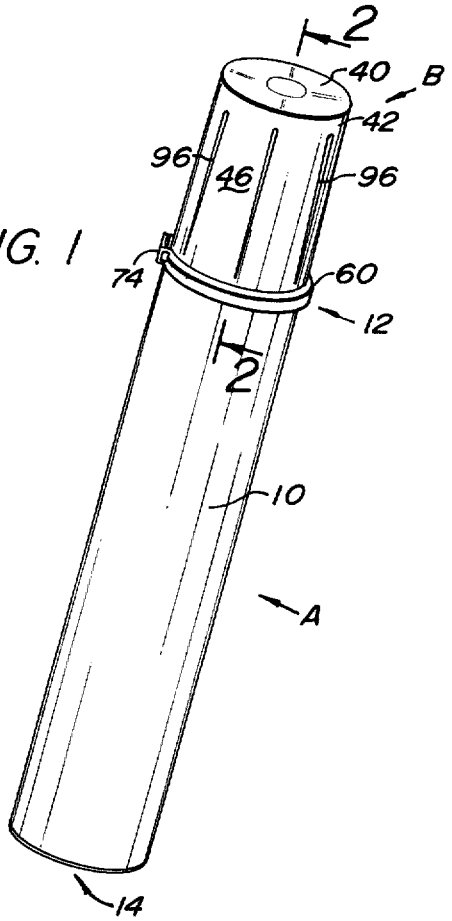
FIG. 1
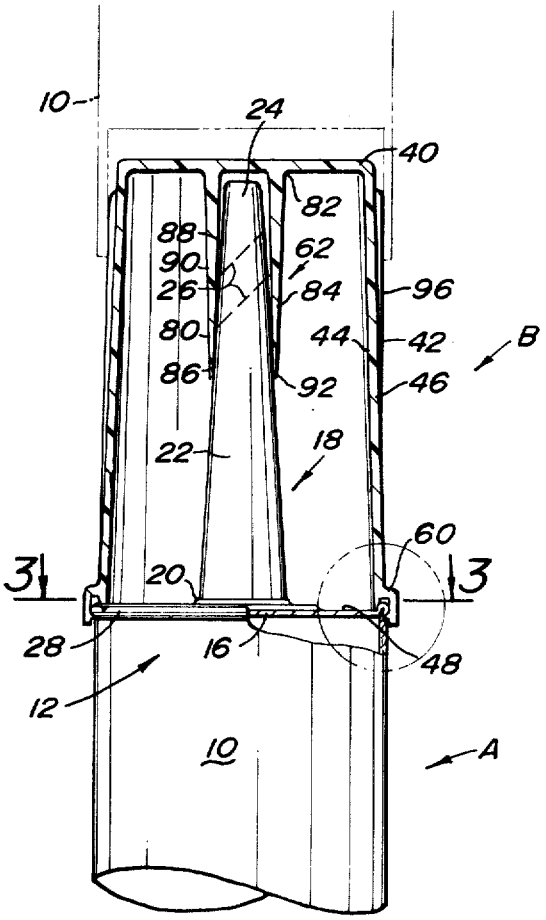
FIG. 2
FIG. 3
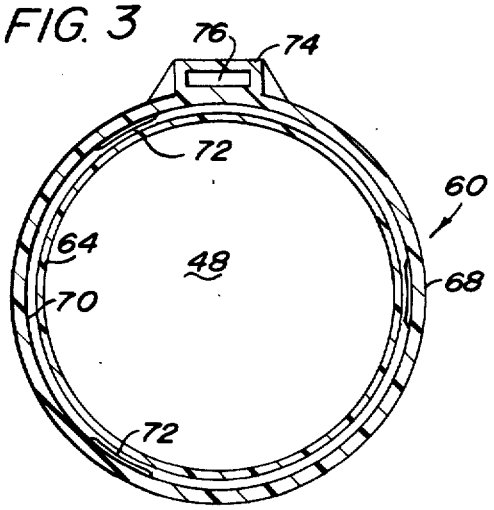
FIG. 4
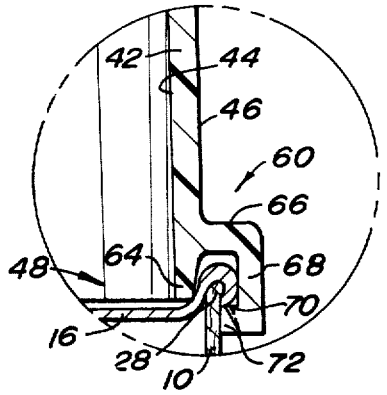

CAP FOR CAULKING CARTRIDGE

BACKGROUND OF THE INVENTION

This is a continuation-in-part application of copending application Ser. No. 418,600 entitled CAULK CAP filed Nov. 23, 1973, now abandoned.

This invention pertains to the art of packaging and more particularly to protective caps for cartridge type containers. The invention is particularly applicable to use as a cap for conventional caulking cartridges and will be described with particular reference thereto.

Conventional caulking cartridges comprise an elongated tubular body member usually constructed from either cardboard, metal or plastic with each end thereof closed so as to maintain the caulking compound disposed therebetween. Protruding outwardly from one end wall of the cartridge is an elongated dispensing spout. This dispensing spout is normally coaxially disposed with the cartridge and is usually constructed from resilient plastic or the like. The other end wall of the cartridge is axially movable within the cartridge body to act as a piston. As this second end is forced through the cartridge toward the dispensing end, the caulking material is forced outwardly from the dispensing spout for application. Generally, these caulking cartridges are employed with a caulking "gun" tool for ease of caulking compound application. As used hereinafter, caulking compound refers to and is meant to include all those materials dispensed in the manner hereinabove generally described.

Normally, the dispensing spouts incorporated into conventional caulking cartridges come in two types, initially open and initially closed. the initially open spout type comprises an elongated tubular member which is converging from its connection with the cartridge and has an open outermost dispensing end. In this arrangement, and prior to initial use, the caulking compound is protected from the atmosphere by means of a seal disposed at the dispensing spout cartridge end. This seal may then be easily broken to permit the caulking compound to be forced from the cartridge. The initially closed type of dispensing spout comprises an elongated converging tubular member having the outermost end thereof initially sealed or closed. When it is desired to apply the caulking compound, this sealed end is merely snipped or cut to thus present a structure substantially similar to the initially open type of spout.

Many times during a caulking operation, the entire contents of a cartridge are not dispensed so that it is desirable to be able to preserve the remaining caulking compound for future application. In such circumstances, it has heretofore been necessary for the user to fabricate by his own design some sort of top or spout cap to eliminate exposure of the remaining compound to the atmosphere through the dispensing spout. If such precautions are not taken, the compound has a tendency to harden within the dispensing spout to thereafter make it virtually impossible to remove the caulking material therefrom in order that the remaining compound may be dispensed as desired. Because of this problem, it is oftentimes necessary to dispose of partially used caulking cartridges which could have otherwise been employed for caulking work but for the hardening of some of the compound material in the dispensing spout.

Another problem heretofore encountered with conventional caulking cartridges is that it has been virtually impossible to stack the cartridges in an end to end axial manner due to the presence of the outwardly protruding dispensing spouts. This situation creates problems and additional cost in packaging quantities of the cartridges for shipping purposes. Likewise, it has been extremely difficult to effectively stack or otherwise display the cartridges on store shelves for sale to consumers. Both of these problems require additional shipping and/or display costs by requiring special packaging methods and display techniques.

Another problem with conventional cartridges as heretofore marketed has been the ease of access to the caulking compound through the dispensing spout itself, particularly once a portion of the cartridge contents have been used. Although this may not present substantial difficulty at a commercial use level, it can present substantial difficulty at the home environment use level. This problem particularly lies with the possibility of children playing with and gaining access to the cartridge contents when the cartridges are inadvertently or indiscriminately left lying around workbenches, garages, etc. Conventional caulking cartridges of the type to which the subject invention is particularly directed have not been child-proofed and once a small child has gained access to the cartridge contents, he could receive either internal or external physical damage through communication with the cartridge contents. It will be appreciated that since so very many different types of caulking compound, patching material, etc., are packaged in what may be termed as conventional caulking cartridges, this problem can be quite severe.

Still another problem with conventional caulking cartridges has been a safety factor. Inasmuch as the dispensing spouts of these caulking cartridges are normally cut on a bias to effect efficient caulking compound dispensing, the outermost end of the spout is rather sharp. This sharp point can create a safety hazard through, for example, causing puncture wounds to persons inadvertently contacting the outermost end of a dispensing spout.

The present invention contemplates new and improved means which overcomes all of the above referred to problems and others and provides a new cartridge cap which is simple in design, economical to manufacture, provides protection for the contents of the cartridge, provides protection for persons coming in contact with the cartridge and which is readily adaptable to use with a plurality of caulking cartridge type containers in varying environments.

BRIEF DESCRIPTION OF THE INVENTION

In accordance with the present invention, there is provided a protective cartridge cap adapted for use with elongated cartridges of the type having a dispensing spout protruding generally coaxially outward from one end thereof. The cap comprises a generally cup-shaped configuration having a top wall and a continuous side wall with inner and outer peripheral surfaces depending generally transversely therefrom. The outermost edge of the side wall defines an open bottom end adapted to be axially received over the cartridge dispensing spout end. An elongated dispensing spout receiver protrudes from the top wall toward the open end and is dimensioned so as to enclose and closely embrace at least a portion of the outside of the spout. Means are included adjacent the open end of the cap for releasably retaining the cap on the cartridge in a protective condition with the dispensing spout disposed in the spout receiver.

In accordance with a more limited aspect of the present invention, the releasable retaining means comprises a resilient bead receiver extending around at least a portion of the cap open end which is adapted to closely receive a bead extending peripherally around the cartridge at the dispensing spout end.

In accordance with another more limited aspect of the present invention, the dispensing spout receiver has a generally circular cross-section dimensioned to closely receive and embrace at least a portion of the dispensing spout between the outermost end of the spout and its connection with the cartridge itself.

In accordance with still another limited aspect of the present invention, the spout receiver further includes means for communicating with the inside portion of the spout adjacent the outermost end thereof.

In accordance with still a further aspect of the present invention, there is provided a combination of an elongated dispensing cartridge and a protective cap therefor wherein the cap protects the integrity of the material inside the cartridge during periods of non-use as well as making the cartridge easier to handle, store and freer of possible injurious elements.

The principal object of the present invention is the provision of a new protective cap for use with conventional caulking cartridges.

Another object of the present invention is the provision of a protective cap which facilitates ease of handling and storage of conventional caulking cartridges.

Another object of the present invention is the provision of a protective cap which renders conventional caulking cartridges substantially child-proof.

Still another object of the present invention is the provision of a protective cap which reduces safety hazards with the conventional caulking cartridges at the dispensing spout areas.

Yet another object of the present invention is the provision of a protective cap which preserves the integrity of the caulking compound like material disposed in the cartridge during periods of storage.

Yet a further object of the present invention is the provision of a protective cap which is readily adaptable to use with normally open or normally closed dispensing spout arrangements in conventional caulking cartridges.

Still another object of the present invention is the provision of a protective cap and caulking cartridge combination.

Still another object of the invention is the provision of the cap-cartridge combination with a forming surface attached to the cap.

Further objects will be obvious from the following detailed description.

DESCRIPTION OF THE FIGURES

The invention may take physical form in certain parts and arrangements of parts, a preferred embodiment of which will be described in detail in the specification and illustrated in the accompanying drawings which form a part hereof and wherein:

FIG. 1 is a perspective view of a conventional caulking cartridge with a protective cap of the subject invention positioned on the dispensing end thereof;

FIG. 2 is a longitudinal cross-sectional view of the protective cap shown in FIG. 1 taken along lines 2—2 and further showing nesting of the cap within the bottom of an adjacent caulking cartridge;

FIG. 3 is a cross-sectional view taken along lines 3—3 of FIG. 2 with the cartridge bead eliminated for ease of illustration;

FIG. 4 is an enlarged view of the area so designated in FIG. 3;

DESCRIPTION OF THE PREFERRED EMBODIMENTS

Figure 5:
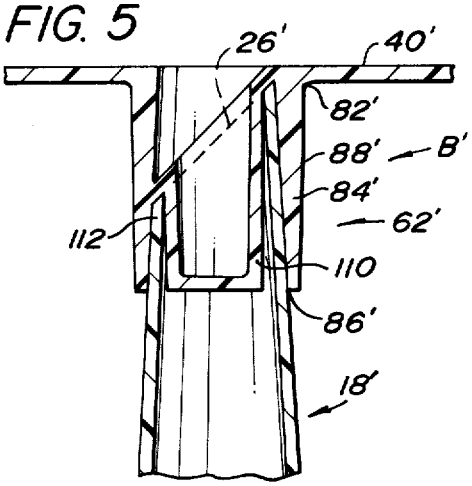
FIGS. 5–7 are alternative arrangements for effecting the concepts of the subject invention as to the spout receiver portion of the cap.

Referring now to the drawings wherein the showings are for purposes of illustrating the preferred embodiments of the invention only and not for purposes of limiting same, the FIGURES show a conventional caulking cartridge A and a protective cap therefor designated B.

The conventional caulking cartridge A comprises an elongated generally tubular body portion 10 having a dispensing end 12 and an actuating end 14. Dispensing end 12 includes end wall 16 having an elongated dispensing spout generally designated 18 protruding outwardly therefrom substantially coaxial with body portion 10. Dispensing spout 18 includes a base 20 conventionally mounted to end wall 16 with a continuous side wall 22 converging toward an outermost closed end 24, i.e., an initially closed type structure. Disposed along side wall 22 from outermost end 24 toward base 20 are conventional severable areas 26 which, when severed, provide an open end and an exit for the compound.

In conventional caulking cartridges, hollow body 10 is normally constructed from cardboard, metal, plastic or the like; end wall 16 is constructed from a light metal, plastic or the like; and, dispensing spout 18 is normally constructed from pliable plastic such as, for example, polyethylene. However, other materials could be employed in practicing the concepts of the invention.

Again, the particular dispensing spout 18 shown in FIG. 2 is considered to be of the initially closed type as shipped from the manufacturer. The type of cartridge arrangement termed initially open comes from the factory with the dispensing spout already severed and with a seal (not shown) at end wall 16 for protecting the integrity of the cartridge contents. In any event, the embodiment of the subject invention here under discussion may be used for both types of dispensing spout structures. Use of the cartridges themselves as far as mode of dispensing is by what is conventionally termed a caulking gun wherein a piston is forced into hollow body 10 through actuating end 14 so as to force that end toward end 12 with the contents of the cartridge, in turn, beind forced outwardly through the dispensing spout.

Also in conventional caulking cartridges, end wall 16 and body portion 10 come together and are joined so as to define a bead 28 arrangement extending circumferentially around the body adjacent dispensing end 12. In the preferred arrangement here under discussion this bead is generally cylindrical although it could take other configurations, depending upon the mode of connection between end wall 16 and tubular body portion 10.

Cap B is generally cup-shaped with top wall 40 having a continuous side wall 42 depending generally transverse therefrom. Side wall 42 includes inner peripheral surface 44 and outer peripheral surface 46. The side wall depends from the top wall in a manner so as to define an open bottom or receiving end 48 and the open end is dimensioned to be generally the same diameter as the diameter of cartridge body 10. Although this cap could be constructed from a number of materials, in the preferred embodiment of the invention here under discussion, it is integrally molded from linear polyethylene plastic.

Disposed adjacent open end 48 is a cap retainer structure generally designated 60 in FIGS. 1 and 2. Depending from top wall 40 toward open end 48 is a dispensing spout receiver generally designated 62 in FIG. 2.

Cap retainer 60 is comprised of a generally U-shaped structure as best shown in FIG. 4 having a first lip 64 extending substantially coextensive with inner peripheral surface 44, a top wall 66 extending outwardly of outer peripheral surface 46 and a second lip 68 extending toward open end 48 generally parallel to first lip 64. Extending inwardly toward first lip 64 and open end 48 from adjacent the outermost end of second lip 68 is a locking bead 70. Although this bead conveniently extends circumferentially around the cap retainer, there are also included three locking bead extensions 72 extending further inwardly toward first lip 64 and open end 48 than bead 70. These extensions are spaced equidistantly around the cap retainer and merely add further retaining force to the cap retainer structure. It will be appreciated that a greater or lesser number of these bead extensions may be employed without departing from the intent and scope of the present invention. Depending outwardly from second lip 68 is a cap retaining means release generally designated 74. This release includes an elongated slot 76 therein to receive a tool such as, for example, a screwdriver to thereby permit leverage to be applied against the cap for releasing the cap retainer structure from the cartridge. Slot 76 may also be conveniently employed to hang or otherwise store the caulking cartridge A and cap B combination during periods of non-use.

Cap retainer 60 is dimensioned so as to fit over bead 28 when the cap is positioned coaxially with cartridge body portion 10. When in position, locking bead 70 and locking bead extensions 72 are received on the underside of bead 28 with lips 64, 68 received against the opposite side portions of bead 28 for retaining the cap in a protective position. Since the cap is molded from a resilient plastic which, in the preferred embodiment, comprises linear polyethylene, bead 70 and bead extensions 72 may be resiliently deformed during installation and removal of the cap without damaging the integrity of the cap structure.

Dispensing spout receiver 62 comprises an elongated generally tubular member 80 having a base 82 connected to top wall 40, continuous side wall 84 and an open outermost end 86. Side wall 84 has inner peripheral surface 88 and an outer peripheral surface 90 with the inner peripheral surface tapering outwardly or diverging from base 82 toward the open end 86 and the outer peripheral surface tapering inwardly or converging over this same area. The thickness of side wall 84 decreases from adjacent base 82 toward open end 86 in order to enhance the receiving capabilities of the receiver itself. That is, the thinner side wall adjacent open end 86 permits greater flexibility of the receiver against spout 18 to accommodate dimensional variances. Inner peripheral surface 88 also includes beveled area 92 at open end 86 to assist in guiding the dispensing spout into the receiver as the cap is installed on the cartridge. The closely embracing condition between the spout and receiver occurs along side wall 22 between the outermost end or open end of the spout and spout base 20. The precise area of contact, however, will vary slightly in accordance with minor design and dimensional variations. However, the important aspect is merely that there be an embracing condition established when the cap is positioned on the cartridge.

Disposed so as to extend axially along a portion of side wall 42 of the protective cap are a plurality of reinforcing ribs 96. Aside from the reinforcing function, the ribs act to assist in nesting stacked cartridges as will hereinafter become more readily apparent. The ribs also act as an indirect stop to prevent over-insertion of the cap into an adjacent cartridge nested thereon.

In using the above described structure, cap B is first removed from its locked position on bead 28 of cartridge body portion 10 by means of container release 74. Once the cap is removed and for the first use, assuming that the cartridge is of the initially closed type, the spout is merely severed along a selected one of severable areas 26 as may be desired to realize a particular flow from the cartridge during a caulking operation. Once the caulking operation has been completed, it is merely necessary to wipe the excess from the outermost end of the dispensing spout and replace the cap over the spout so that cap retainer 60 engages bead 28. Because of the closely embracing nature of dispensing spout receiver 62 in communication with dispensing spout side wall 22, the remaining contents of the cartridge, particularly that material in the spout which would otherwise be subjected to exposure to the atmosphere, is protected in much the manner as a cap or lid on a bottle protects the contents of the bottle from hardening, decomposition or evaporation. Thereafter, when additional caulking is desired, it is merely necessary to remove the cap, reinsert the cartridge in the caulking gun and proceed with the actual caulking work.

In order to facilitate ease of stacking on store shelves as well as ease of packing for shipping purposes, the diameter of top wall 40 is dimensioned to be slightly less than the diameter of cartridge body 10 at actuating end 14. In this manner, and since the actuating end of a conventional caulking cartridge is recessed, one cartridge, including a protective cap may be received in the actuating end 14 of an adjacent cartridge 10 as shown in phantom in FIG. 2. Reinforcing ribs 96 act to assist in retaining the cartridges in this end to end stacked conditions and in addition limit insertion of the cap to prevent its contact with the movable piston in the bottom wall 98 of the other cartridge. This possible arrangement is deemed to be particularly valuable in marketing the cartridges as, for example, in retail store facilities to provide a cleaner and more eye appealing layout on the store shelves.

Again, it should be appreciated that the preferred embodiment shown and described with reference to FIGS. 1–4 may be effectively employed with either the initially open or initially closed type of spout structures. The difference in spout structures is apparent only until first use of the cartridges.

Figure 6:
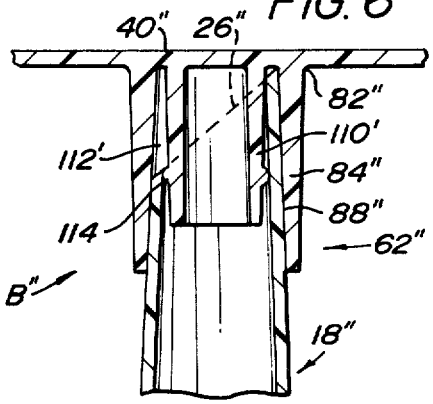
Figure 7:
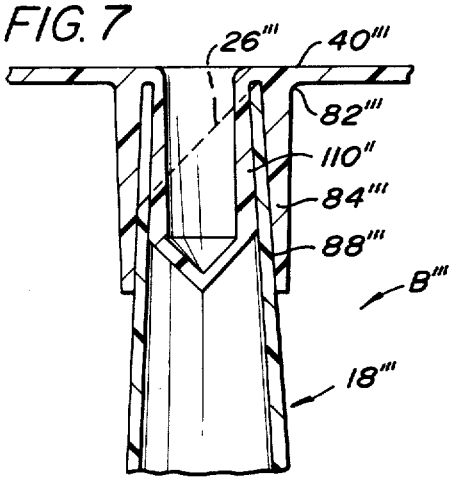

FIGS. 5–7 show alternative embodiments for practicing the subject invention which are particularly adapted for and directed to use with the initially open dispensing spouts. For ease of illustration, like elements appearing in FIGS. 5–7 have like numerals except for primed suffixes and new elements have new numerals.

In FIG. 5, dispensing spout receiver 62' includes an inner portion 110 dimensioned to be received inside spout 18' from the outermost open dispensing end thereof. In addition, the bottom of the receiving area or channel 112 defined between the outer peripheral surface of the inner portion 110 and inner peripheral surface 88' of spout receiver side wall 84' is dimensioned and configured so as to closely mate with the outermost end of the dispensing spout. That is, the outermost end of the spout is cut on a bias as is conventional to facilitate proper application of the caulking compound and the receiving area 112 is configured to closely abut the cut end. Because of this abutting nature as well as the inclusion of inner portion 110, the cap may not be employed as shipped from the manufacturer with those spouts which are initially closed.

FIG. 6 shows yet another variation wherein inner portion 110' includes an outwardly protruding spout engaging bead 114 which engages the inner peripheral surface of dispensing spout 18'' so as to create a close fitting condition on both the inner and outer surfaces of the spout side wall. It will be noted that receiving area 112' in this arrangements is not biased so as to closely engage the outermost edge of the spout. This alternative arrangement permits the protective cap to easily be affixed to a cartridge without regard to the precise relative rotated positions between the cap and cartridge as required with the embodiment of FIG. 5. Again, the alternative embodiment of FIG. 6 is limited to the initially open type of dispensing spout as shipped from the manufacturer.

Finally, the embodiment of FIG. 7 shows a slight rearrangement of the structure hereinabove discussed with reference to FIG. 6 so as to eliminate a need for an engaging bead. In this embodiment, the inner portion 110'' diverges outwardly from its origin at top wall 40'''. The outer peripheral surface of this inner portion, along with inner peripheral surface 88''' then act to closely engage both the inner and outer surface of dispensing spout 18''' over a portion of the length thereof from the open outermost end.

Figure 8:
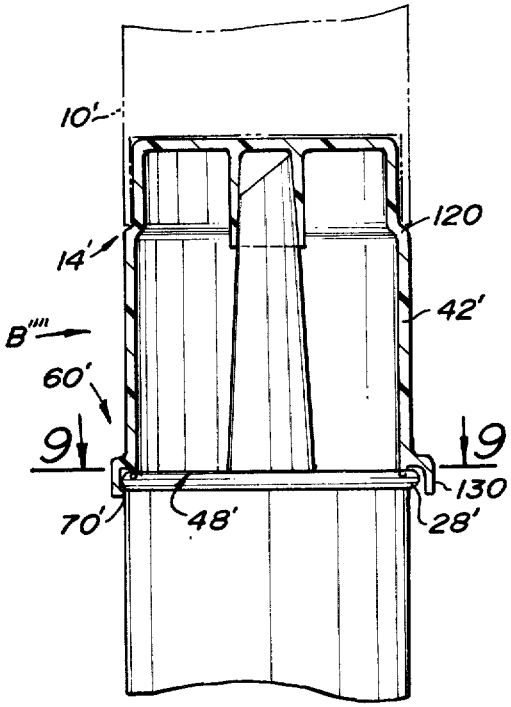
FIG. 8 is a longitudinal cross-sectional view of an alternative cap sidewall and retainer design.
Figure 9:
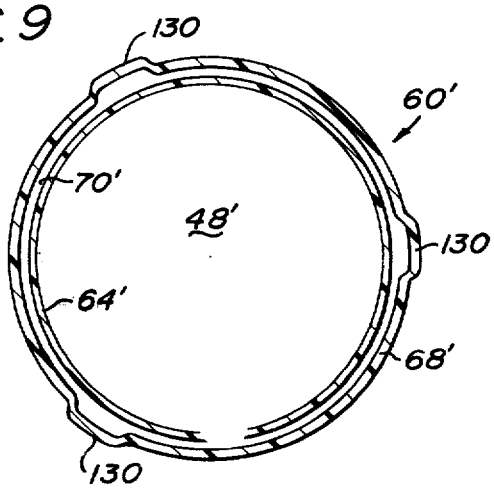
FIG. 9 is a cross-sectional view taken along lines 9—9 in FIG. 8 with the cartridge bead again eliminated for ease of illustration.

FIGS. 8 and 9 show a slightly varied construction for the side wall of the cap as well as the cap retainer. Again, like numerals including a primed suffix will be used to designate like components and new numerals will be used to designate new components.

In this arrangement, continuous side wall 42' is disposed substantially transverse to the top wall and has a diameter substantially identical to the outside diameter of the caulking cartridge. Adjacent the top wall, continuous side wall 42' decreases in diameter and thereby forms a ledge 120 extending circumferentially therearound. This decrease in dimension is such that the uppermost portion of the cap may be received inside the actuating end 14' of an adjacent caulking cartridge 10' with the outermost end of the cartridge resting on ledge 120. This structural arrangement provides a positive stop for insertion of the cap into the adjacent cartridge to effectively prevent undesired inadvertent compression of the caulking material within the cartridge or damage to the cartridge itself which could otherwise occur.

Cap retainer 60' includes a slight variation by eliminating the retaining means release 74 employed in the FIGS. 1–4 embodiment. That is, according to the alternative arrangement of FIGS. 8 and 9, there are included three release means 130 spaced equidistantly around the cap retainer to extend outwardly from second lip 68'. These release means merely comprise relief areas in the cap retainer which facilitate receipt of a tool such as, for example, a screwdriver to permit resilient deflection of the cap retainer to release it from an engaging position with bead 28'. This embodiment also includes a locking bead 70' extending inwardly toward open end 48' from second lip 68' for gripping the underside of bead 28' but does not include the locking bead extension as in the embodiment of FIGS. 1–4.

Figure 10:
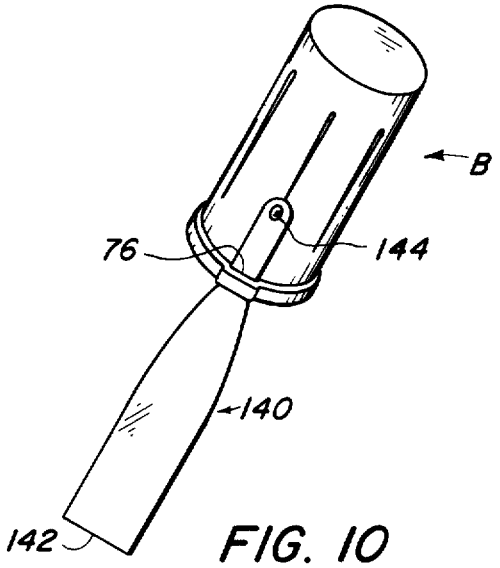
FIG. 10 is a perspective view of a modification of the cap of this invention incorporating a forming blade.

Referring to FIG. 10, a forming blade 140 may be attached to cap B for use in the conventional manner. Obviously, the blade could be serrated or otherwise modified at its forming end 142 to suit specialized needs without departing from the inventive concept. The blade is illustrated here as attached to the sidewall of the cap by rivet 144 and extending through the slot 76 to provide two anchoring points for the blade to prevent relative movement between the blade and handle (cap). Two rivets would serve equally well if desired.

Figure 11:
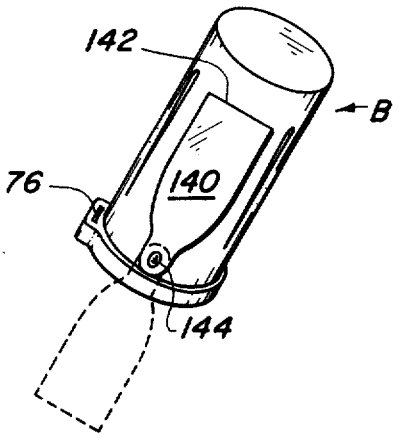
FIG. 11 illustrates a cap with forming blade similar to FIG. 10 but with the blade being pivotable.

Alternatively, it may be desirable to have a blade which is adjustable relative to the handle (cap) and which is no longer than the cap. FIG. 11 illustrates such modifications, no further explanation appears necessary.

The invention has now been described with reference to the preferred embodiment. Obviously, modifications and alterations will occur to others upon the reading and understanding of this specification. It is our intention to include all such modifications and alterations insofar as they come within the scope of the appended claims or the equivalents thereof.

I claim:

1. The combination of an elongated dispensing caulking cartridge and protective cap therefor, said combination comprising:

an elongated tubular cartridge having at least one stationary closed end with a coaxial dispensing spout protruding outwardly therefrom, said spout generally converging from said closed end toward an outermost end, said cartridge further having means forming a bead disposed peripherally around said closed end for receiving and releasably retaining said cap on said cartridge;

a movable piston disposed within the cartridge remote from the closed end, the protective cap comprising a generally cup shaped member having a top wall and a continuous side wall including inner and outer peripheral surfaces depending therefrom, the outermost edge of said side wall defining an open bottom end dimensioned to be axially received over said one end of said cartridge; an elongated dispensing spout receiver protruding from said top wall and substantially transverse thereto toward said open end, said receiver being dimensioned so as to receive an axial portion of said spout with a segment of said axial portion being closely embraced by said receiver; and means disposed at said open bottom for releasably retaining said cap generally coaxially disposed over said one end with said portion of said spout disposed in said spout receiver, said receiver and said spout being coaxially aligned when the cap is coaxially aligned with said one end, said retaining means comprising a resilient bead receiver extending peripherially around at least portions of said side wall adjacent said open end dimensioned to closely receive said bead means, said bead receiver comprising a generally U-shaped cross-section having a first lip substantially coplanar with said inner peripheral surface, a bead receiver top wall extending generally transversely outward of said outer peripheral surface and a second lip extending downwardly beyond said first lip generally parallel thereto, said second lip including a resiliently deformable locking bead dimensioned to be closely received over said bead means with said locking bead received on the side of said U-shaped cross-section spaced remote from said closed end, means for releasing said retaining means from a retaining condition on said cartridge, said dispensing spout having a generally circular cross-section, said dispensing spout receiver having a generally circular cross-sectional dimension to receive an axial portion of said spout from said outermost end and closely embrace at least a segment of said axial portion spaced from said outermost end, at least the inner peripheral surface of said spout receiver tapering outwardly from said top wall over substantially the entire length thereof the outer peripheral surface of said spout receiver tapering inwardly from said top wall over substantially the entire length thereof, the taper of said inner peripheral surface being greater than the taper of said outer peripheral surface, said top wall being dimensioned such that a portion of said cap from said top wall toward its open end is receivable in the other end of another cartridge identical to said cartridge in an end to end axial relationship, and means on said cap for limiting the amount of insertion of said cap into said another cartridge without the cap top wall contacting the piston in said another cartridge.

2. The combination as defined in claim 1 further including locking bead extensions disposed around said locking bead to extend further inwardly toward said first lip from said locking bead.

3. The combination as defined in claim 1 wherein said releasing means comprises at least one tab-like member protruding outwardly of said second lip.

4. The combination as defined in claim 1 wherein said bead receiver extends completely around the periphery of said side wall at said open end.

5. The combination as defined in claim 1 further including a spout receiver inner portion coaxial with said receiver dimensioned to be received within said dispensing spout from said outermost end.

6. The combination as defined in claim 5 wherein said inner portion includes engaging means for positively engaging the inner peripheral wall of said spout when said cap is in position on said cartridge.

7. The combination as defined in claim 2 including a spout receiver inner portion coaxial with said receiver dimensioned to be received within said dispensing spout from said outermost end said inner portion including engaging means for positively engaging the inner peripheral wall of said spout when said cap is positioned on said cartridge.

8. The combination as defined in claim 1 including a forming blade attached to the cap.

9. The combination as defined in claim 8 wherein the blade is rigidly fixed relative to the cap.

10. The combination as defined in claim 8 wherein the blade is pivotable relative to the cap.

* * * * *